US005268127A

United States Patent [19]

Wu

[11] Patent Number: 5,268,127

[45] Date of Patent: Dec. 7, 1993

[54] METHOD FOR INHIBITING CORROSION OF CARBON STEEL IN CONTACT WITH HYDROFLUORIC ACID AND TETRAHYDROTHIOPHENE-1,1-DIOXIDE

[75] Inventor: Yiing-Mei Wu, Sewell, N.J.

[73] Assignee: Mobil Oil Corporation, Fairfax, Va.

[21] Appl. No.: 913,329

[22] Filed: Jul. 15, 1992

[51] Int. Cl.[5] ..... C23F 11/12; C23F 11/16; C23F 11/18

[52] U.S. Cl. ..... 252/387; 252/389.62; 252/395; 422/12

[58] Field of Search ..... 252/387, 388, 395, 389.62, 252/8.555; 422/12

[56] References Cited

U.S. PATENT DOCUMENTS

| | | | |
|---|---|---|---|
| 2,028,243 | 1/1936 | Martin et al. | 252/387 |
| 3,932,130 | 1/1976 | Bennett et al. | 252/387 |
| 5,002,673 | 3/1991 | Williams et al. | 252/8.555 |

OTHER PUBLICATIONS

1 Handbook of Petroleum Refining Processes 23-28 (R. A. Meyers, ed., 1986).

N. Hackerman, E. S. Snavely, Jr., and L. D. Fiel, Corros. Sci. vol. 7,39 (1967).

Acello, S. J., and Green, N. D., Corrosion, vol. 18 p. 286t, 1962.

*Primary Examiner*—Robert L. Stoll
*Assistant Examiner*—Valerie Fee
*Attorney, Agent, or Firm*—Alexander J. McKillop; Dennis P. Santini; Robert B. Furr, Jr.

[57] ABSTRACT

The present invention provides a method for inhibiting corrosion of carbon steel in contact with a mixture of hydrofluoric acid and tetrahydrothiophene-1,1-dioxide comprising adding a corrosion inhibiting amount of an alkali metal halide to said mixture of hydrofluoric acid and tetrahydrothiophene-1,1-dioxide.

11 Claims, No Drawings

METHOD FOR INHIBITING CORROSION OF CARBON STEEL IN CONTACT WITH HYDROFLUORIC ACID AND TETRAHYDROTHIOPHENE-1,1-DIOXIDE

FIELD OF THE INVENTION

This invention relates to the art of corrosion control. More particularly, this invention provides methods for inhibiting the corrosion of carbon steel in contact with hydrofluoric acid and tetrahydrothiophene-1,1,-dioxide.

BACKGROUND OF THE INVENTION

Hydrofluoric acid is useful in such diverse fields as isoparaffin-olefin alkylation, fluorination, semiconductor manufacture, steriod synthesis, tantalum recovery, and xylene separation.

Industrial isoparaffin-olefin alkylation processes have historically used concentrated hydrofluoric acid catalysts under relatively low temperature conditions. The acid strength is preferably maintained at 88 to 94 weight percent by the continuous addition of fresh acid and the continuous withdrawal of spent acid. As used herein, the term "concentrated hydrofluoric acid" refers to an essentially anhydrous liquid containing at least about 85 weight percent HF.

Alkylation is a reaction in which an alkyl group is added to an organic molecule. Thus an isoparaffin can be reacted with an olefin to provide an isoparaffin of higher molecular weight. Industrially, the concept depends on the reaction of a $C_2$ to $C_5$ olefin with isobutane in the presence of an acidic catalyst producing a so-called alkylate. This alkylate is a valuable blending component in the manufacture of gasolines due not only to its high octane rating but also to its sensitivity to octane-enhancing additives. For a survey of hydrofluoric acid catalyzed alkylation, see 1 Handbook of Petroleum Refining Processes 23–28 (R. A. Meyers, ed., 1986).

Recently, more stringent environmental regulations have prompted a new look at methods of storing and processing hydrofluoric acid. Specifically, researchers have investigated possible solvents which could be used to dilute the hydrofluoric acid (thus rendering it safer) while preserving its commercial useful characteristics. Tetrahydrothiophene-1,1-dioxide (also referred to herein as sulfolane) has been found to be a useful additive for hydrofluoric acid in isoparaffin-olefin alkylation.

Dilute solutions of water and hydrofluoric acid are highly corrosive toward carbon steel. Neat hydrofluoric acid is essentially noncorrosive toward carbon steel, and it is industry practice to handle and store neat hydrofluoric acid using carbon steel equipment. Neat tetrahydrothiophene-1,1-dioxide (sulfolane) is similarly relatively noncorrosive toward carbon steel. Surprisingly, mixtures of hydrofluoric acid and tetrahydrothiophene-1,1-dioxide are highly corrovive. Carbon steel process equipment would has a projected useful life of no more than a few months in the presence of mixtures of hydrofluoric acid and tetrahydrothiophene-1,1-dioxide.

Diluting HF with tetrahydrothiophene-1,1-dioxide overcomes the fuming tendency of the HF and makes handling and storing the HF both easier and safer. Further, even if the mixture is accidentally released from its containment facility, the HF tends to remain in the liquid solution rather than to form a dense vapor cloud.

Thus while mixtures of HF and tetrahydrothiophene-1,1-dioxide are safer than neat HF in the event of an accidental release, the mixture cannot be stored in carbon steel without extensive corrosion control measures. Clearly, then, it would be desirable to provide an economical additive which decreases the corrosion rate of carbon steel in the presence of mixtures of HF and tetrahydrothiophene-1,1-dioxide.

SUMMARY OF THE INVENTION

The present invention provides a method for inhibiting corrosion of carbon steel in contact with a mixture of hydrofluoric acid and tetrahydrothiophene-1,1-dioxide comprising adding a corrosion inhibiting amount of an alkali metal halide to said solution containing hydrofluoric acid and tetrahydrothiophene-1,1-dioxide.

DETAILED DESCRIPTION

HF is used as a catalyst in commercial alylation processes. The corrosion rates of common metals, such as iron, copper and nickel, are low in anhydrous HF liquid. N. Hackerman, E. S. Snavely, Jr., and L. D. Fiel, Corros. Sci. Vol. 7, 39 (1967).

Because of increasingly stringent environmental regulations, mixtures of HF and tetrahydrothiophene-1,1-dioxide (sulfolane) have been tested as alternative catalysts for isoparaffin/olefin alkylation, and these mixtures have been found to be highly corrosive.

The present invention provides a method which reduces the corrosion rate of carbon steels in HF/sulfolane systems. While not to limit the scope of the invention by a recitation of theory, data suggest that the additive of the invention causes the carbon steel to form a protective film which then inhibits further corrosion by separating the corrosive HF/sulfolane mixture from the carbon steel.

By reducing corrosion rate, the invention makes HF/sulfolane mixtures commercially viable replacements for neat or concentrated HF in an existing alkylation process unit. The invention not only reduces the cost of operating a commercial HF alkylation process unit but also makes the unit safer. Further, by decreasing the both the fuming tendency of the stored HF, as well as the likelyhood that this mixture might be releasaed, the invention renders HF alkylation a more environmentally acceptable option.

Adding halogen ions (such as chlorides and fluorides) to sulfuric acid, on the other hand, markedly increases its corrosivity toward austenitic stainless steels. It is believed that the halogen ions are harmful to the protective films formed in the sulfuric acid/austenitic stainless steel system. Acello, S. J., and Greene, N. D., Corrosion, Vol. 18 pp. 286t, 1962. In view of the well-accepted teachings that adding halogen ions is detrimental to the stability of a protective film, the observed behavior in the present inventive method for carbon steel in an HF/sulfolane solution is indeed surprising.

Alkali metal halides useful as additives in the method of the invention contain at least one member selected from Group IA elements and at least one member selected from the Group VIIB elements. The preferred Group IA elements include Li, Na, and K, while the preferred Group VIIB elements include F, Cl, Br, and I. Sodium fluoride and potassium fluoride are particularly preferred.

The alkali metal fluorides useful in the present invention are highly soluble in liquid HF. Sodium fluoride can be prepared by fusing cryolite ($Na_3AlF_6$) with NaOH. Cryolite is a naturally occurring fluoride of sodium and aluminum which can also be synthesized from fluorspar, sulfuric acid, hydrated alumina, and sodium carbonate.

The present invention contemplates treating solutions of HF and tetrahydrothiophene-1,1-dioxide (sulfolane) containing from about 1 to about 99 weight percent HF, more typically from about 10 to about 90 weight percent HF. Corrosion inhibiting amounts of the alkali metal halide range from about 0.001 to about 40 weight percent, preferably from about 0.005 to about 10 weight percent, more preferably from about 0.01 to about 3 weight percent. The most preferred dosage for a particular solution of HF and tetrahydrothiophene-1,1-dioxide (sulfolane) may be readily determined by one skilled in the art with only minimal trial and error. The solution of HF and tetrahydrothiophene-1,1-dioxide may optionally contain water in concentration of from about 0.05 to about 30 weight percent, preferably from about 0.1 to about 5 weight percent, more preferably from about 1 to about 3 weight percent. While water has been observed to decrease the corrosivity of the HF/tetrahydrothiophene-1,1-dioxide mixture, the alkali metal halide additive is also effective in anhydrous mixtures.

EXAMPLES

The following Examples demonstrate the corrosion control method of the present invention.

EXAMPLE 1

Sulfolane Purification

Sulfolane was purified by the Jones Method by distillation below 100° C. (i) from solid sodium hydroxide, (ii) from sulfuric acid plus hydrogen peroxide, (iii) from solid sodium hydroxide, and (iv) twice from calcium hydride. Jones, J. G., Inorg, Chem., Vol. 5, pp. 1229, 1996.

EXAMPLE 2

Corrosion Test

Weight loss corrosion test procedure: A static test procedure was selected to compare the corrosivities of solutions containing various amounts of NaF to assess the inhibition effect. The corrosivities of the HF/sulfolane solutions were tested at:

Temperature, °F.: 75 and 85.

HF concentration, wt %: 50.

Stirring rate, rmp: 0 and 100.

HF/sulfolane loading was accomplished at liquid nitrogen temperature through a pressure regulator. 130 ml of each solution were placed into a Teflon coated stainless steel autoclave. A carbon steel weight-loss coupon (2.2 $cm^2$) was suspended in the liquid phase and the autoclave was maintained at the test temperature for up to 5 days by means of a temperature controller. A liquid scrubber system was attached to the autoclave for the disposal of HF after each experiment. The weight losses of the coupons after the test were determined and the corresponding corrosion rates were calculated in terms of mpy.

EXAMPLE 2

Corrosion Test Results

The test results of carbon steel are shown in Table 1. The results show that:

Neat HF or neat sulfolane is not corrosive.

HF/sulfolane is very corrosive.

NaF is an effective corrosion inhibiting additve, and significantly reduces corrosivity at low dosages. With less than 2 weight percent NaF, the corrosion rate decreased from 145 mpy (Example 2, Run No. 4) to 28 mpy (Example 2, Run No. 5).

TABLE 1

Corrosion Results
Temperature, °F.: 85
Stirring Rate, rmp: 0
HF/sulfolane ratio: 1/1

| | | Test Time days | Corrosion Rate, mpy |
|---|---|---|---|
| 1. | Sulfolane | 4 | 0.1 |
| 2. | HF | 5 | 0.3 |
| 3. | HF/sulfolane | 5 | 424 |
| 4. | HF/sulfolane + 2% Water (Wt.) | 3 | 145 |
| 5. | HF/sulfolane + 2% Water + 1.7% NaF (wt.) | 4 | 28 |

Changes and modifications in the specifically described embodiments can be carried out without departing from the scope of the invention which is intended to be limited only by the scope of the appended claims.

What is claimed is:

1. A method for inhibiting corrosion of carbon steel in contact with a mixture containing from about 50 to about 99 weight percent hydrofluoric acid, tetrahydrothiophene-1,1-dioxide and up to about 30 weight percent water comprising adding a corrosion inhibiting amount of an alkali metal halide to said mixture.

2. The method of claim 1 wherein said corrosion inhibiting amount of alkali metal halide is from about 0.001 to about 40 weight percent based onthe total weight of the solution.

3. The method of claim 2 wherein said corrosion inhibiting amount of alkali metal halide is from about 0.005 to about 10 weight percent based on the total weight of the solution.

4. The method of claim 3 wherein said corrosion inhibiting amount of alkali metal halide is from about 0.01 to about 3 weight percent based on the total weight of the solution.

5. The method of claim 1 wherein said mixture of hydrofluoric acid and tetrahydrothiophene-1,1-dioxide contains from about 0.05 to about 30 weight percent water based on the total weight of the solution.

6. The method of claim 5 wherein said mixture is hydrofluoric acid and tetrahydrothiophene-1,1-dioxide contains from about 0.1 to about 5 weight percent water based on the total weight of the solution.

7. The method of claim 5 wherein said mixture of hydrofluoric acid and tetrahydrothiophene-1,1-dioxide contains from about 1 to about 3 weight percent water based on the total weight of the solution.

8. A method for inhibiting corrosion of carbon steel in contact with a mixture consisting essentially of from about 50 to about 99 weight percent hydrofluoric acid, tetrahydrothiophene-1,1-dioxide and up to about 30 weight percent water comprising adding a corrosion inhibiting amount of an alkali metal halide to said mixture.

9. The method of claim 8 wherein said corrosion inhibiting amount of alkali metal halide is from about 0.001 to about 40 weight percent based on the total weight of the solution.

10. The method of claim 9 wherein said corrosion inhibiting amount of alkali metal halide is from about 0.005 to about 10 weight percent based on the total weight of the solution.

11. The method of claim 10 wherein said corrosion inhibiting amount of alkali metal halide is from about 0.01 to about 3 weight percent based on the total weight of the solution.

* * * * *

UNITED STATES PATENT AND TRADEMARK OFFICE

CERTIFICATE OF CORRECTION

PATENT NO. : 5,268,127
DATED : December 7, 1993
INVENTOR(S) : Y. M. Wu

It is certified that error appears in the above-indentified patent and that said Letters Patent is hereby corrected as shown below:

Col. 4, line 56, delete "is" and insert --of--

Col. 4, line 60, "5" should be --6--

Signed and Sealed this

Thirty-first Day of May, 1994

Bruce Lehman

*Attest:*

BRUCE LEHMAN

*Attesting Officer*

*Commissioner of Patents and Trademarks*